US006296556B1

(12) United States Patent
Gegenheimer

(10) Patent No.: US 6,296,556 B1
(45) Date of Patent: Oct. 2, 2001

(54) CENTRIFUGAL SLIDE GRINDER

(76) Inventor: Helmut Gegenheimer, Schlossstrasse 6, D-75210 Keltern-Weiler (DE)

( * ) Notice: Subject to any disclaimer, the term of this patent is extended or adjusted under 35 U.S.C. 154(b) by 0 days.

(21) Appl. No.: 09/025,234

(22) Filed: Feb. 18, 1998

(30) Foreign Application Priority Data

Feb. 19, 1997 (DE) ..... 297 02 859 U

(51) Int. Cl.[7] ..... B24B 31/00
(52) U.S. Cl. ..... 451/326; 451/327; 451/328
(58) Field of Search ..... 451/32, 35, 74, 451/103, 104, 106, 109, 110, 111, 112, 113, 118, 327, 328, 326

(56) References Cited

U.S. PATENT DOCUMENTS

| | | | | |
|---|---|---|---|---|
| 4,850,151 | * | 7/1989 | Ditscherlein | 451/328 |
| 4,939,871 | * | 7/1990 | Ditscherlein | 451/327 |
| 4,958,776 | * | 9/1990 | Walther | 451/327 |
| 5,012,620 | * | 5/1991 | McNeil | 451/327 |
| 5,189,842 | * | 3/1993 | Kobayashi et al. | 451/328 |
| 5,211,673 | * | 5/1993 | Ditscherlein | 451/327 |
| 5,279,074 | * | 1/1994 | Davidson | 451/328 |
| 5,476,415 | * | 12/1995 | Nishimura et al. | 451/327 |
| 5,823,861 | * | 10/1998 | Kobayashi et al. | 451/327 |

FOREIGN PATENT DOCUMENTS

| | | |
|---|---|---|
| 3604619 | 8/1987 | (DE) . |
| 4214060 | 11/1993 | (DE) . |
| 9521726 | 8/1995 | (WO) . |

* cited by examiner

*Primary Examiner*—Eileen P. Morgan
(74) *Attorney, Agent, or Firm*—Antonelli, Terry, Stout & Kraus, LLP

(57) ABSTRACT

The invention is a centrifugal grinder. The grinder contains a rotary receptacle lower part and a stationary receptacle upper part, wherein the receptacle lower part and the receptacle upper part each have a ceramic part on opposing faces defining an opening into the grinder between the receptacle parts, and an adjustable straight gap which includes the opening provided between the ceramic parts extending radially relative to an axis of rotation of the rotary receptacle.

13 Claims, 3 Drawing Sheets

CENTRIFUGAL SLIDE GRINDER

BACKGROUND OF THE INVENTION

1. Field of the Invention

The invention relates to a centrifugal slide grinder with a shell-like rotary receptacle bottom part and a stationary essentially cylindrical receptacle top part.

2. Description of the Prior Art

Centrifugal slide grinders are used for surface machining especially of smaller parts and workpieces which are moved together with the grinding wheels and optionally with a liquid process agent. As DE 44 28 817 C2 shows, a known centrifugal slide grinder has a top-opening, and shell-like bottom part which is rotary-driven around a vertical axis. Above the bottom part there is a stationary cylindrical receptacle top part which rests with its lower edge on the upper edge of the bottom part with the interposition of a seal. When the bottom part is caused to rotate the workpieces to be machined are forced radially to the outside in the bottom part until they meet the inner wall of the stationary receptacle top part which causes a braking action to be applied to the work pieces. Radially peripheral workpiece motion which causes intensive grinding arises by workpieces following from upstream.

The transition area between the upper edge of the turning bottom part and the lower edge of the stationary receptacle top part is very susceptible to wear. Attempts have therefore been made to make the seal which acts between these two parts as a slip ring seal, the slip ring located on the bottom part and/or on the receptacle top part consisting of ceramic. In this way the wear which occurs in the seal can be reduced, however ceramic rings of a larger diameter are very expensive and the additional problem arises that the diameter of the ceramic rings and thus the diameter of the receptacle top part is limited by production technology to a maximum roughly 50 cm, so that a centrifugal slide grinder of this type in its volume and also in its performance is subject to serious limitations. Attempts have been made to form a ceramic ring from several ceramic ring segments, in doing so however problems occurred with regard to sealing.

In DE-P9 44 28 817 the seal which acts between the two parts is formed by a hardened steel ring on the bottom part and a felt ring on the receptacle upper part. By means of screws the desired contact pressure is established between the soft ring seal of felt or nonwoven material and the steel ring. If the felt ring is worn for example by the working of fine grinding media into the felt, on the contact surface between the two annular seals a gap forms which can no longer be equalized by the felt seal. This and the wear due to friction on the contact surfaces between the receptacle upper and bottom part then leads to the fact that extremely small parts can no longer be machined.

In known centrifugal slide grinders with slip ring seals in which the parts of the receptacle bottom part and top part which form the seals are pressed elastically against one another, lubrication takes place by means of a lubricating fluid which can penetrate to the interior of the receptacle part.

In many grinding processes it is desirable or necessary to ensure absolute dryness within the grinder, which is not the case in known grinders which operate with a fluid.

SUMMARY OF THE INVENTION

The invention is a centrifugal slide grinder which operates reliably, which has long service life, but which also enables absolutely dry grinding.

The invention provides a centrifugal slide grinder which has the receptacle bottom and top part provided each with a ceramic part on their opposing faces.

The hard ceramic parts which are made preferably annular, therefore made as rings, ensure that even when the receptacle upper part is tilted relative to the receptacle bottom part no welding of the bordering surfaces of the receptacle bottom part and top part takes place which permanently ensures uniform rotation capacity of the upper part relative to the lower part. In one preferred embodiment between the ceramic parts a finite gap is present. The size of the gap is generally such that it is in the particle size range or somewhat less, so that particles cannot penetrate through the gap from the interior of the grinder to the outside. The configuration of the ceramic rings on the lower receptacle top part and the upper face of the receptacle bottom part ensures that when a very small abrasive particle penetrates into the gap, by which the aforementioned tilting can occur, simply the relative rotary motion between the top and bottom part pulverizes the particle, and the aforementioned damage cannot occur, as would take place for example when using metal.

In another preferred embodiment the gap be adjustable. In this way the gap width can be matched to the size of the abrasive particles used. Here other preferred embodiments provide for the gap having a size from 0.05 to 0.5 mm and especially the gap having a size of roughly 0.3 mm, of course it being necessary to watch that the gap is not larger than the (minimum) dimensions of the abrasive particles.

The adjustability of the gap can be achieved in different ways, for example by washers or the like. One highly preferred embodiment has the gap being adjustable using set screws, especially the set screws being located on the periphery of the receptacle upper part and a support part bearing the latter.

In another preferred embodiment the inner wall of the receptacle upper part tapers radially conically to the inside in its lower end section. This results in the receptacle upper part over most of its height having a relatively large diameter which decreases as a result of the conical configuration of the lower end region to the lower edge with a clearly smaller diameter. Since the diameter of the lower edge determines the necessary size or diameter of the seal, in the centrifugal slide grinder of the invention one-piece slip rings of ceramic can be used, although the receptacle upper part has a relatively large volume and thus high output. In known centrifugal slide grinders the workpieces to be machined, especially in the presence of legs sensitive to buckling, etc., can be damaged or bent in the grinding process; this is due to the fact that the workpieces in the transition from the rotating bottom part to the stationary receptacle top part are strongly braked and at the same time experience deflection from the inner wall of the bottom part which runs obliquely upward at a angle of roughly 30 to 45 degrees to the essentially vertical inner wall of the receptacle upper part. Since the lower section of the receptacle upper part tapers conically to the inside according to the embodiment just described, its inner wall runs at an angle relative to the vertical. The inner wall of the bottom part also runs obliquely to the vertical. By means of the corresponding configuration the angle between the two inner walls of the bottom part and the receptacle upper part can be kept small so that the load resulting from the deflection of the workpieces to be machined is low. In one preferred embodiment the inner walls of the receptacle upper part and bottom part are flush in the area of the gap. The inner wall of the bottom part therefore passes smoothly into the inner wall of the receptacle upper part. In this way there is no unevenness in the transition area as is present by tilting or unwinding in the prior art.

For the configuration and especially the alignment of the contact surfaces between the lower edge of the receptacle upper part and the upper edge of the bottom part various alternatives are conceivable. In one possible embodiment it is provided that the gap is aligned at an angle which deviates clearly from a right angle to the inner walls of the receptacle upper part and bottom part, especially the gap being aligned essentially horizontally or vertically to the axis of rotation. In this way axial motion of the receptacle upper part or bottom part acts uniformly on the contact surface.

Alternatively it can be provided that the gap is aligned at an angle to the inner walls of the receptacle upper part and bottom part. The outer part of the receptacle bottom part consists preferably of aluminum or an aluminum alloy. The same applies to the receptacle upper part. The lining consists preferably of polyurethane.

BRIEF DESCRIPTION OF THE DRAWINGS

Other advantages and features of the invention follow from the claims and from the following description in which embodiments of the invention are detailed with reference to the drawings in particular.

DESCRIPTION OF THE PREFERRED EMBODIMENTS

Figure 1A:
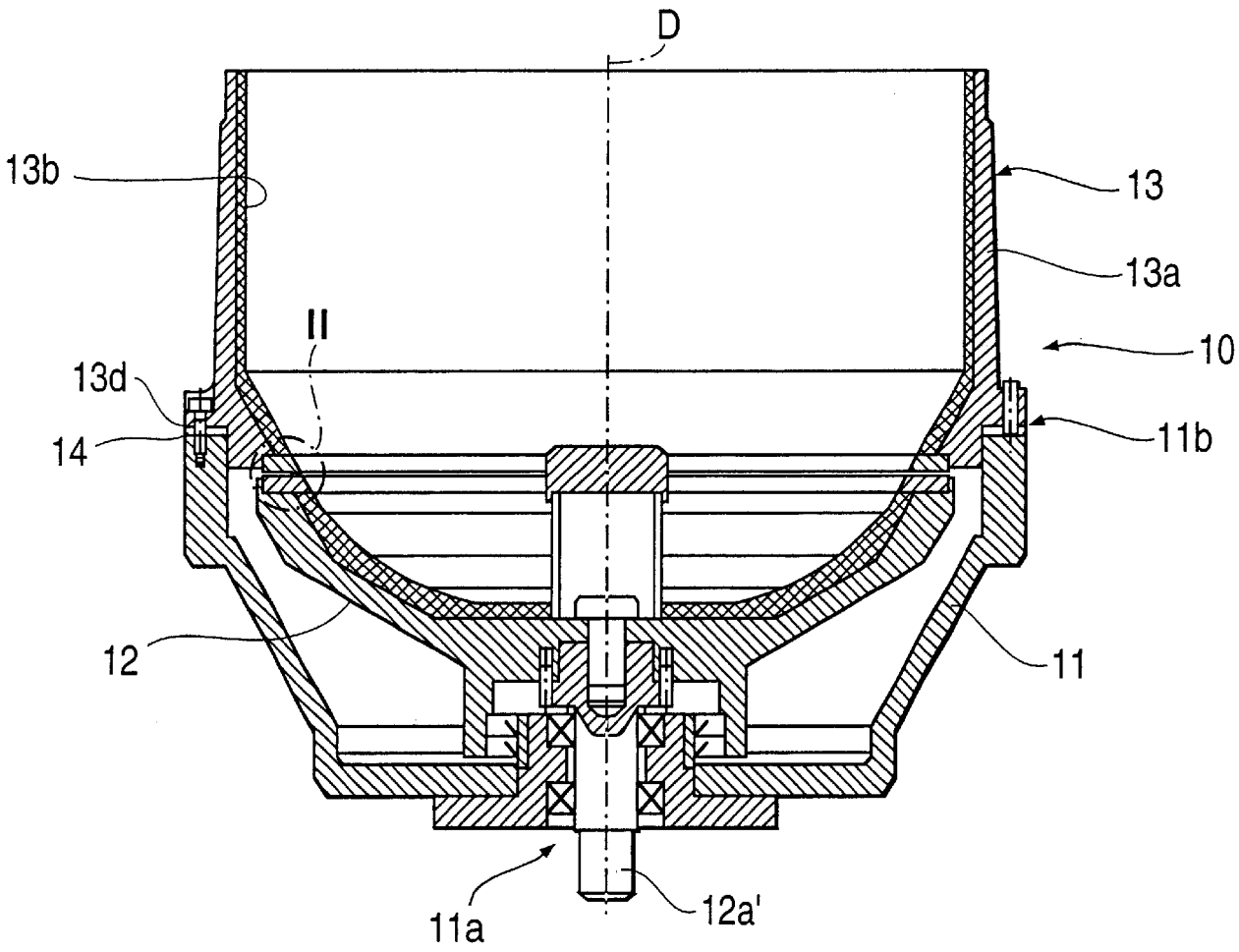
FIG. 1*a* shows a vertical section through a centrifugal slide grinder in accordance with the invention with a configuration II and FIG. 1*b* shows a vertical section through a centrifugal slide grinder in accordance with the invention with a configuration III of the gap between the receptacle bottom part and upper part.
Figure 1B:
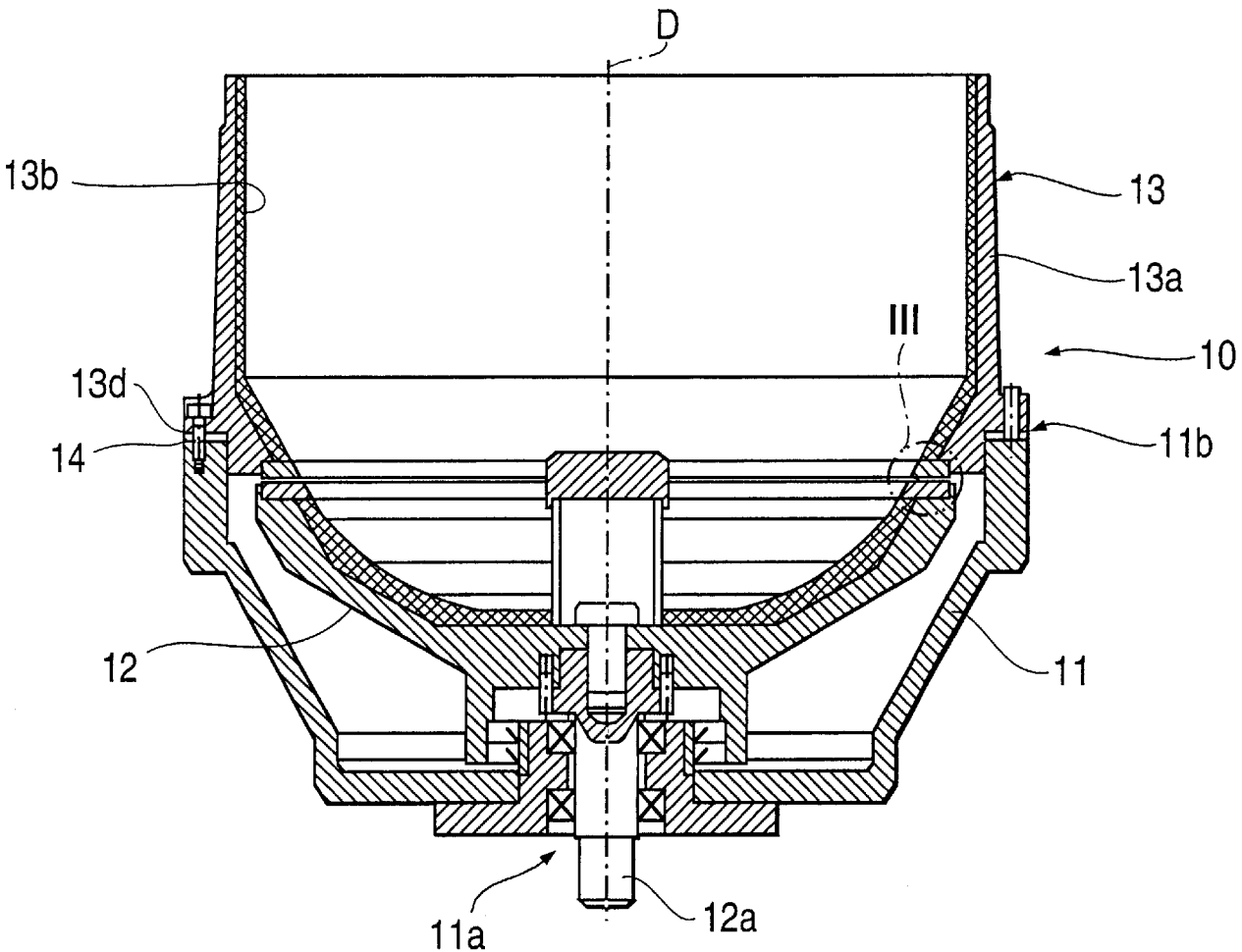

Centrifugal slide grinder 10 has two embodiments as illustrated in FIGS. 1*a* and 1*b* as claimed in the invention each having an external, housing-like support part 11 which is attached to a machine support which is not shown. Rotary receptacle bottom part 12 is pivotally mounted via its drive axis 12*a*' on support part 11 via bearing 11*a*. Receptacle bottom part 12 is driven via axis 12*a*' by a drive which is not shown.

Receptacle upper part 13, joined to support part 11 sits on upper edge 11*b* of support part 11. The receptacle upper part is joined to support part 11 via adjustment screws 14 and is adjustable by means of these screws in its height in the direction of axis of rotation D. Screws 14 with their heads 16 each lie on flange 13*d* which is located radially to the outside on receptacle upper part 13 and which screws 14 with their threaded shafts project through.

Receptacle upper part 13 has metallic outer part 13*a* which is provided on the inside with coating 13*b*. Outer part 13*a* has an essentially circular cylindrical shape and is tapered radially conically to the inside on its inner wall. Coating 13*b* follows essentially this conical configuration so that the lower edge of receptacle upper part 13 has a smaller inside diameter than the essentially circular cylindrical section of receptacle upper part 13 located over it.

Figure 3:
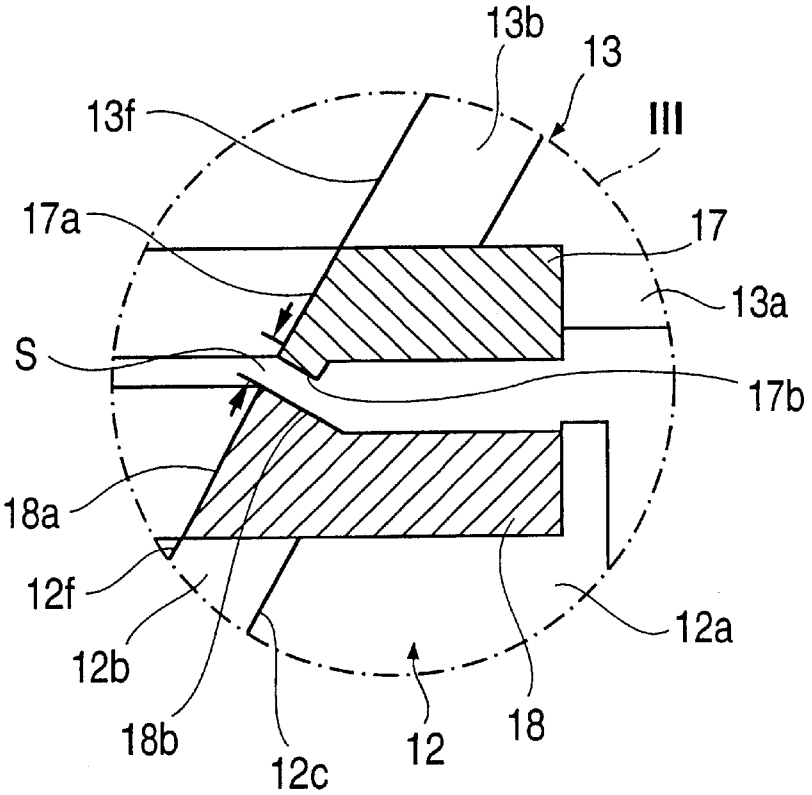
Figure 2:
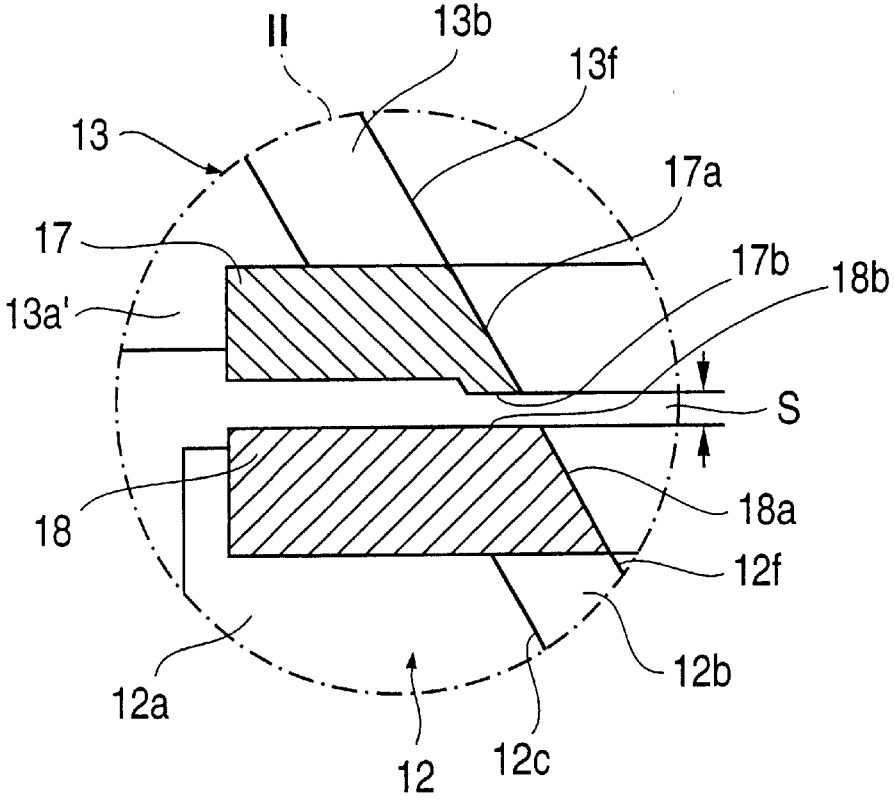
FIG. 2 shows in an enlarged representation of a first embodiment of the invention in which the gap configuration is according to II in FIG. 1*a* and FIG. 3 likewise shows in an enlarged representation of a second embodiment of the invention in which the gap configuration according to III in FIG. 1*b*.

In the embodiments of FIGS. 2 and 3, on the lower face of receptacle upper part 13 annular ceramic part 17 is attached with front side 17*a* is flush with inner wall 13*f* of coating 13*b* of receptacle upper part 13. In the forward area ceramic part 17 has projection 17*b* pointed downward.

In the embodiments of FIGS. 2 and 3, bottom part 12 likewise has metallic outer part 12*a* and coating 12*b*. In the area adjacent to receptacle upper part 13, outer part 12*a* of bottom part 12 has inner wall 12*c* which flares conically. Outer part 12*a* of bottom part 12 is likewise provided with coating 12*b* and its inner wall 12*f* follows essentially inner wall 12*c* of outer part 12*a*. In the area facing receptacle upper part 13, bottom part 12 is likewise provided with annular ceramic part 18 with inside wall 18*a* which is flush with inside wall 17*a* and also inside wall 12*f* of coating 12*b*.

Between projection 17*b* and top 18*b* of ceramic part 18 adjustable slot S is formed with a finite slot width which depends on the size of the grinding material used, but which is preferably on the order or 0.3 mm.

In the embodiment of FIG. 2, top 18*b* and the bottom of projection 17*b* run essentially horizontally and thus at an angle not equal to 90 degrees to inside walls 13*f*, 17*a*, 18*a*, 12*f*.

The embodiment of FIG. 3 corresponds essentially to that of FIG. 2. One difference is that top 18*b* of ceramic part 18 which runs from the inside to the outside, is angled to the top. The bottom of projection 17*b* runs parallel to the front or inner area of 18*b* of ceramic part 18. Thus slot S in the embodiment of FIG. 3 is aligned such that it forms a right angle to inside walls 13*f*, 17*a*, 18*a*, 12*f*.

It has been shown that by means of the configuration of the invention with gap S bounded by two ceramic parts 17, 18 between receptacle bottom part 12 and upper part 13, dry abrasive added to the bottom and top parts, along with the parts to be ground, causes the parts to be ground by means of the dry abrasive being in contact with the tumbled parts. The resultant grinding is reliably done without the danger of welding of the walls or areas 17*b*, 18*b* which border slot S.

What is claimed is:

1. A centrifugal grinder comprising:

a rotary lower part and a stationary upper part with an inner side of the lower and upper parts defining a receptacle which receives objects to be ground and grinding particles which grind the objects during rotation of the rotary lower part;

the rotary lower part and the stationary upper part each comprising a ceramic part on opposed faces defining an opening extending from outside the receptacle into the receptacle; and wherein the opening comprises two pairs of horizontally opposed faces with a first pair of opposed faces being radially displaced from the receptacle relative to an axis of rotation of the grinder and separated by a first distance and a second pair of opposed faces which are part of the ceramic parts terminating at the receptacle and being separated by a second distance which is less the first distance; and an adjustment mechanism which adjusts the first and second distances by moving the rotary lower part and the stationary upper part vertically relative to each other.

2. A grinder in accordance with claim 1 wherein:

the second pair of surfaces has one surface which terminates the stationary upper part in the receptacle and is an end of a projection which is part of the ceramic part with one surface of the projection being part of a surface which defines the receptacle.

3. A grinder in accordance with claim 2 wherein:

the one surface and the surface of the projection define an acute angle.

4. A centrifugal grinder as claimed in claim 1, wherein:

the second distance ranges from 0.05 to 0.5 mm.

5. A centrifugal grinder comprising:

a rotary lower part and a stationary upper part with an inner side of the lower and upper parts defining a receptacle which receives objects to be ground and grinding particles which grind objects during rotation of the rotary lower part;

the rotary lower part and the stationary upper part each comprising a ceramic part on opposed faces defining an opening extending from outside the receptacle into the receptacle; and wherein the opening comprises two pairs of parallel opposed faces which are inclined relative to a horizontal orientation with a first pair of opposed faces being radially displaced from the receptacle relative to an axis of rotation of the grinder and separated by a first distance and a second pair of opposed faces which are part of the ceramic parts terminating at the receptacle and being separated by a second distance which is less the first distance; and an adjustment mechanism which adjusts the first and second distances by moving the rotary lower part and the stationary upper part vertically relative to each other.

6. A grinder in accordance with claim 5 wherein:

the second pair of surfaces has one surface which terminates the stationary upper part in the receptacle and is an end of a projection which is part of the ceramic part with one surface of the projection being part of a surface which defines the receptacle.

7. A grinder in accordance with claim 6 wherein:

the one surface and the surface of the projection define a right angle.

8. A centrifugal grinder as claimed in claim 5, wherein:

the second distance ranges from 0.05 to 0.5 mm.

9. A centrifugal grinder comprising:

a rotary lower part and a stationary upper part with an inner side of the lower and upper parts defining a receptacle which receives objects to be ground and grinding particles which grind objects during rotation of the rotary lower part;

the rotary lower part and the stationary upper part each comprising a ceramic part on opposed faces defining an opening extending from outside the receptacle into the receptacle; and wherein the opening comprises two pairs of opposed faces with a first pair of faces being radially displaced from the receptacle relative to an axis of rotation of the grinder and separated by a first distance and a second pair of parallel opposed faces which are part of the ceramic parts terminating at receptacle and being separated by a second distance which is less than the first distance; and an adjustment mechanism which adjusts the first and second distances by moving the rotary lower part and the stationary upper part vertically relative to each other.

10. A grinder in accordance with claim 9 wherein:

the second pair of surfaces has one surface which terminates the stationary upper part in the receptacle and is an end of a projection which is part of the ceramic part with one surface of the projection being part of a surface which defines the receptacle.

11. A grinder in accordance with claim 10 wherein:

the one surface and the surface of the projection define an acute angle.

12. A grinder in accordance with claim 10 wherein:

the one surface and the surface of the projection define a right angle.

13. A centrifugal grinder as claimed in claim 9, wherein:

the second distance ranges from 0.05 to 0.5 mm.

* * * * *